US011066276B2

(12) United States Patent
Schmidt et al.

(10) Patent No.: US 11,066,276 B2
(45) Date of Patent: Jul. 20, 2021

(54) ENHANCED DOOR DETECTION

(71) Applicant: Otis Elevator Company, Farmington, CT (US)

(72) Inventors: Walter Thomas Schmidt, Marlborough, CT (US); Goran Djuknic, New York, NY (US); Norbert Antony Murray Hootsmans, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 569 days.

(21) Appl. No.: 15/966,652

(22) Filed: Apr. 30, 2018

(65) Prior Publication Data

US 2019/0330026 A1 Oct. 31, 2019

(51) Int. Cl.

| | |
|---|---|
| ***B66B 13/26*** | (2006.01) |
| ***E05F 15/43*** | (2015.01) |
| ***E05F 15/73*** | (2015.01) |

(52) U.S. Cl.

CPC ..... *B66B 13/26* (2013.01); *E05F 15/43* (2015.01); *E05F 15/73* (2015.01); *E05F 2015/435* (2015.01); *E05F 2015/765* (2015.01); *E05Y 2400/54* (2013.01); *E05Y 2900/104* (2013.01); *E05Y 2900/132* (2013.01)

(58) Field of Classification Search

CPC ..... B66B 13/26; E05F 15/43; E05F 15/73; E05F 2015/435; E05F 2015/765; E05Y 2400/54; E05Y 2900/104; E05Y 2900/132

See application file for complete search history.

(56) References Cited

U.S. PATENT DOCUMENTS

| | | | | |
|---|---|---|---|---|
| 3,852,592 A | | 12/1974 | Scoville et al. | |
| 4,973,837 A | | 11/1990 | Bradbeer | |
| 5,142,152 A | | 8/1992 | Boiucaner | |
| 5,387,768 A | | 2/1995 | Izard et al. | |
| 5,518,086 A | * | 5/1996 | Tyni | B66B 13/143 187/316 |

(Continued)

FOREIGN PATENT DOCUMENTS

| | | |
|---|---|---|
| CN | 101578229 A | 11/2009 |
| CN | 102241354 A | 11/2011 |

(Continued)

OTHER PUBLICATIONS

YouTube, [online]; [retrieved on Apr. 30, 2018]; retrieved from the Internet https://www.youtube.com/watch?v=CJITSoPnHLA "Flatscan SW—English Version", BEA Sensors Europe, Published Apr. 26, 2016.

European Search Report for Application No. 19172006.9; dated Sep. 27, 2019; 9 Pages.

*Primary Examiner* — Jeffrey Donels

(74) *Attorney, Agent, or Firm* — Cantor Colburn LLP

(57) ABSTRACT

A door control system is provided. Aspects includes a sensor having a field of view in proximity to a door threshold of an entrance to an occupancy area, wherein the sensor is adapted to detect objects in the door threshold and a landing area proximate to the door threshold, wherein the sensor is operated based on a movement of a door in the door threshold. And based at least upon detecting an object within a portion of the door threshold or the landing area, the sensor operable to signal a door operation controller to perform an action.

22 Claims, 9 Drawing Sheets

(56) References Cited

U.S. PATENT DOCUMENTS

| | | | | |
|---|---|---|---|---|
| 5,963,000 | A | 10/1999 | Tsutsumi et al. | |
| 6,080,981 | A | 6/2000 | Payne | |
| 6,205,710 | B1 * | 3/2001 | Busse | G01S 13/48 49/27 |
| 6,970,085 | B2 | 11/2005 | Kabe et al. | |
| 7,042,492 | B2 | 5/2006 | Spinelli | |
| 7,349,074 | B2 * | 3/2008 | Zambon | G01S 17/87 356/5.01 |
| 7,984,590 | B2 * | 7/2011 | Hoshide | E05F 15/73 49/31 |
| 8,904,708 | B2 | 12/2014 | Zachhio et al. | |
| 9,145,727 | B2 * | 9/2015 | Albers | E05F 15/73 |
| 9,341,013 | B2 * | 5/2016 | Iwata | E05F 15/73 |
| 9,751,727 | B1 | 9/2017 | Novak | |
| 10,040,670 | B2 * | 8/2018 | Kattainen | G01V 8/20 |
| 10,837,215 | B2 * | 11/2020 | Schmidt | B66B 13/146 |
| 2001/0045327 | A1 * | 11/2001 | Shemanske, II | B66B 13/143 187/317 |
| 2014/0034426 | A1 * | 2/2014 | Novak | B66B 13/26 187/317 |

FOREIGN PATENT DOCUMENTS

| | | | | |
|---|---|---|---|---|
| CN | 102037204 | B | 8/2014 | |
| CN | 106966275 | A | 7/2017 | |
| DE | 10260109 | B4 | 5/2014 | |
| EP | 0699619 | A2 | 3/1996 | |
| EP | 0935045 | A2 | 8/1999 | |
| EP | 1313321 | B1 | 10/2008 | |
| EP | 1997769 | A1 | 12/2008 | |
| EP | 3192763 | A1 | 7/2017 | |
| GB | 2453804 | A | 4/2009 | |
| JP | H06144757 | A | 5/1994 | |
| JP | 2002046965 | A | 2/2002 | |
| JP | 2009046253 | A | 3/2009 | |
| WO | 9510057 | A1 | 4/1995 | |
| WO | 9858869 | A1 | 12/1998 | |
| WO | WO-2006067222 | A2 * | 6/2006 | G06T 7/269 |
| WO | 2008084058 | A2 | 7/2008 | |
| WO | 2018064745 | A1 | 4/2018 | |

* cited by examiner

ENHANCED DOOR DETECTION

BACKGROUND

The subject matter disclosed herein generally relates to door systems and, more particularly, to enhanced door detection systems.

Elevator systems, typically, utilize one or more automatic sliding doors for entry in to an elevator car. Door detection is utilized to detect the presence of obstructions in the path of the doors before and during closure for the protection of the passengers and objects. In the event of an obstruction, the elevator system can prevent the elevator doors from closing and/or reopen the elevator doors.

BRIEF DESCRIPTION

According to one embodiment, a door control system is provided. The door control system includes a sensor having a field of view in proximity to a door threshold of an entrance to an occupancy area, wherein the sensor is adapted to detect objects in the door threshold and a landing area proximate to the door threshold, wherein the sensor is operated based on a movement of a door in the door threshold. And based at least upon detecting an object within a portion of the door threshold or the landing area, the sensor operable to signal a door operation controller to perform an action.

In addition to one or more of the features described above, or as an alternative, further embodiments of the system may include that the sensor is mechanically coupled to the door.

In addition to one or more of the features described above, or as an alternative, further embodiments of the system may include that the field of view of the sensor is adjusted by movement of the door based on the mechanical coupling.

In addition to one or more of the features described above, or as an alternative, further embodiments of the system may include that the occupancy area is an elevator car in an elevator system.

In addition to one or more of the features described above, or as an alternative, further embodiments of the system may include that operating the sensor comprises adjusting the field of view of the sensor in the door threshold.

In addition to one or more of the features described above, or as an alternative, further embodiments of the system may include that operating the sensor comprises adjusting the field of view of the sensor in the landing area proximate to the door threshold.

In addition to one or more of the features described above, or as an alternative, further embodiments of the system may include that operating the sensor based at least in part on the movement of the door includes responsively adjusting the sensor to align a center of the field of view within an opening defined by the door in the door threshold.

In addition to one or more of the features described above, or as an alternative, further embodiments of the system may include that adjusting the sensor comprises at least one of: panning the sensor, tilting the sensor, and adjusting a zoom of the sensor.

In addition to one or more of the features described above, or as an alternative, further embodiments of the system may include that the door control system further includes a light curtain in proximity to the door, wherein the light curtain is adapted to detect objects in the door threshold when the door is in an open state.

In addition to one or more of the features described above, or as an alternative, further embodiments of the system may include that the sensor comprises at least one of: a radar sensor, a time of flight sensor, an infrared sensor, a three dimensional light curtain, and an optical sensor.

In addition to one or more of the features described above, or as an alternative, further embodiments of the system may include that the action comprises engaging a security measure for the door.

According to one embodiment, a method for operating a door control system is provided. The door control system including a sensor having a field of view in proximity to a door threshold of an entrance to an occupancy area, wherein the sensor is adapted to detect objects in the door threshold and a landing area proximate to the door. The method includes operating the sensor based at least in part on a movement of the door in the door threshold and based at least upon detecting an object within a portion of the door threshold or the landing area, signaling a door operation controller to perform an action.

In addition to one or more of the features described above, or as an alternative, further embodiments of the method may include that the sensor is mechanically coupled to the door.

In addition to one or more of the features described above, or as an alternative, further embodiments of the method may include that the field of view of the sensor is adjusted by movement of the door based on the mechanical coupling.

In addition to one or more of the features described above, or as an alternative, further embodiments of the method may include that the occupancy area is an elevator car in an elevator system.

In addition to one or more of the features described above, or as an alternative, further embodiments of the method may include that operating the sensor comprises adjusting the field of view of the sensor in the door threshold.

In addition to one or more of the features described above, or as an alternative, further embodiments of the method may include that operating the sensor comprises adjusting the field of view of the sensor in the landing area proximate to the door threshold.

In addition to one or more of the features described above, or as an alternative, further embodiments of the method may include that operating the sensor based at least in part on the movement of the door includes responsively adjusting the sensor to align a center of the field of view with an opening defined by the door in the door threshold.

In addition to one or more of the features described above, or as an alternative, further embodiments of the method may include that adjusting the sensor comprises at least one of: panning the sensor, tilting the sensor, and adjusting a zoom of the sensor.

In addition to one or more of the features described above, or as an alternative, further embodiments of the method may include that the door control system further includes a light curtain affixed to the door, wherein the light curtain is adapted to detect objects in the door threshold when the door is in an open state.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
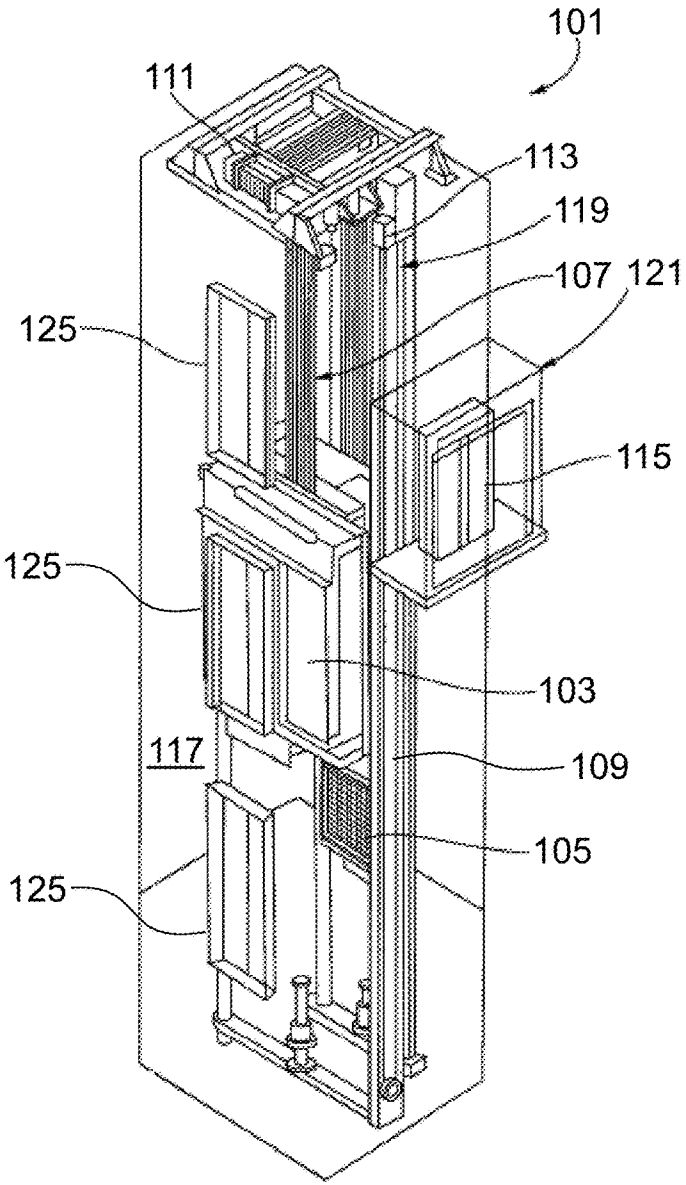
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
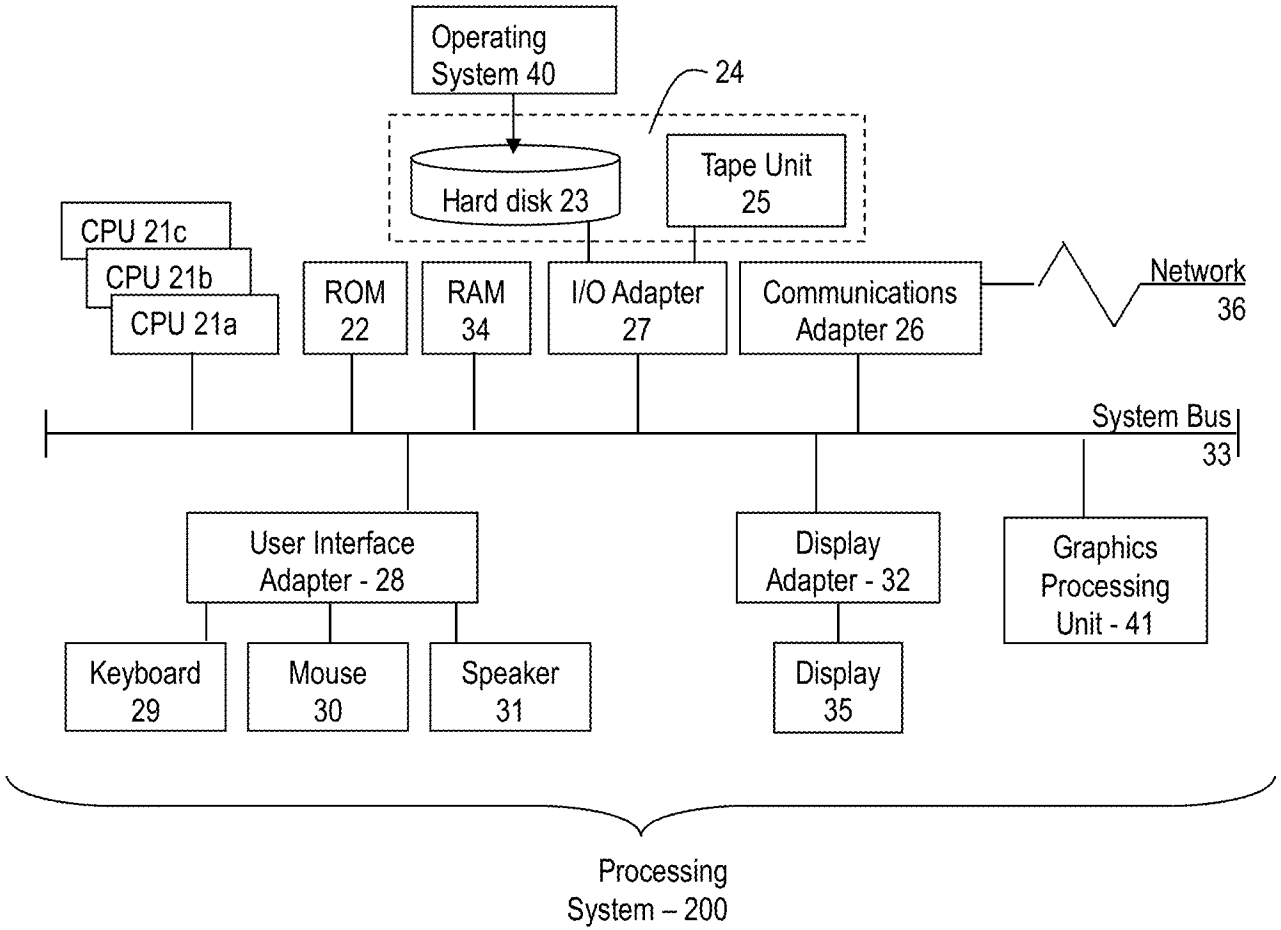
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of the aspects of the disclosure, one or more embodiments address the shortcomings of the prior art by providing an elevator system that provides for door detection and safety features that are in line with changes to elevator code. Particularly, the elevator systems must utilize a single sensor to sense objects (e.g. passengers, etc.) both in the door plane and on the landing area. Two sensor approaches include a 3D light curtain and a volumetric sensor (RADAR, Time of Flight (ToF), Infrared, optical, etc.). Sensor design determines the field of view for a given sensor. Current candidate volumetric solutions can be used for center opening doors of 1.8 meter width or side opening doors of 1.2 m width. These sensors cannot be used for wide doors because they will not be able to view the entire code-specified sensing area with existing capabilities. This is demonstrated in FIGS. 3 and 4, where a sensor with the same angle of view meets requirements for center opening doors but does not meet requirements for side opening doors.

Figure 3:
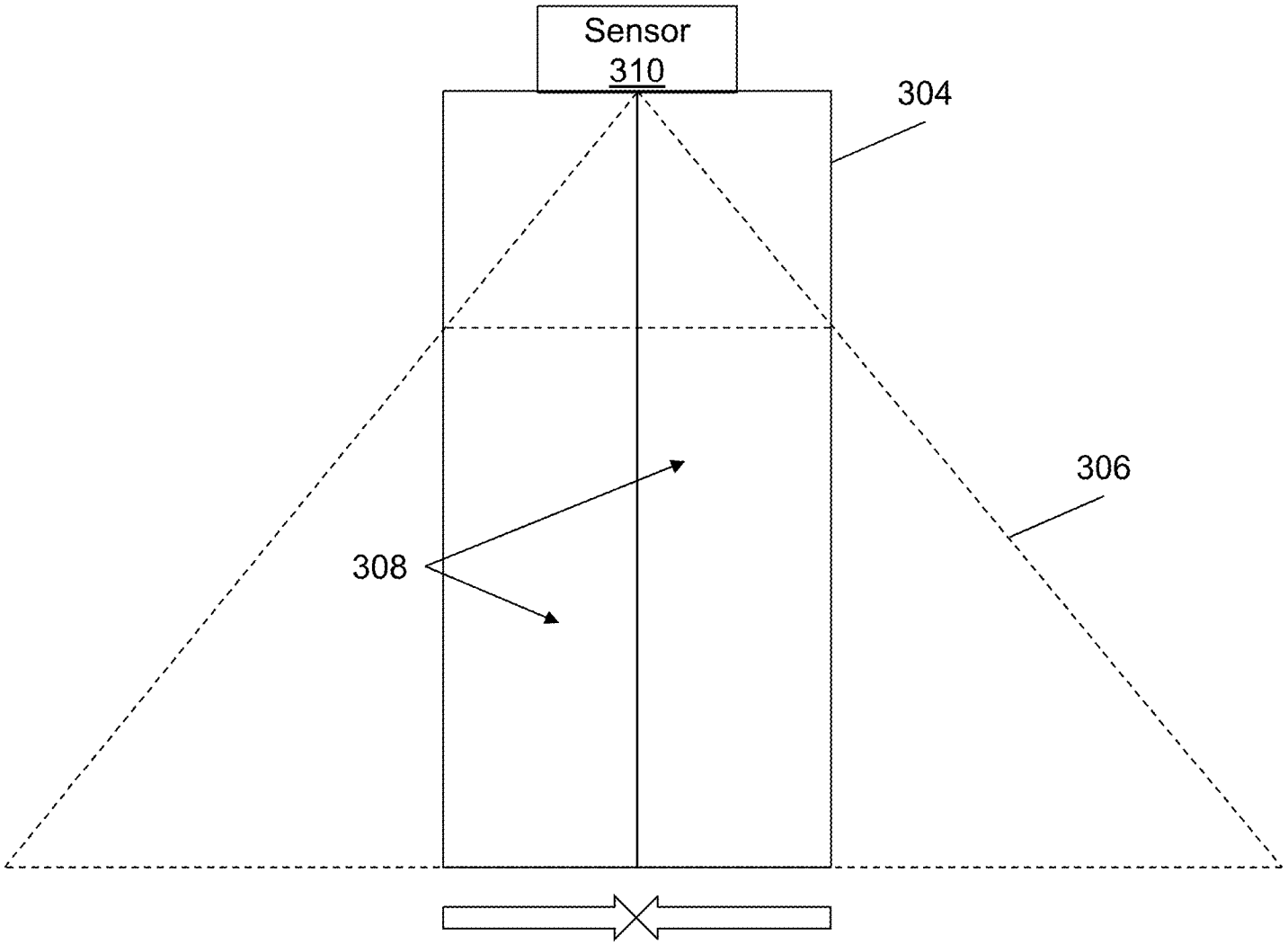
FIG. 3 depicts a center opening elevator door with a sensor.

FIG. 3 depicts a center opening elevator door with a sensor. The center opening door 304 includes a sensor 310 located at the top of the elevator door 304. The field of view 306 (sometimes referred to as "cone of view") of the sensor 310. In the illustration, the field of view 306 covers the required sensing area 308 which is portions of the center opening elevator door 304.

Figure 4:
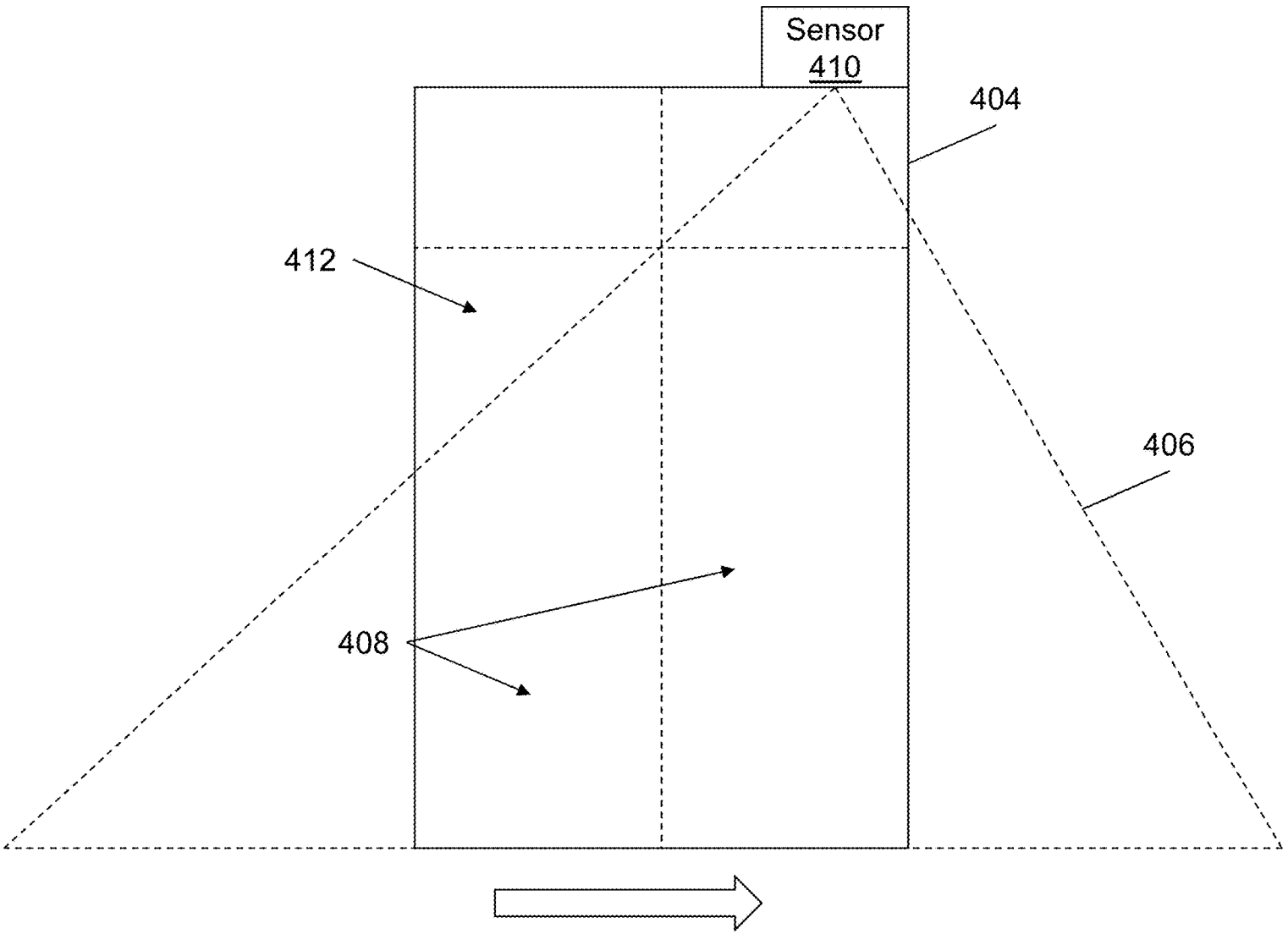
FIG. 4 depicts a side opening elevator door with a sensor.

FIG. 4 depicts a side opening elevator door with a sensor. The side opening door 404 includes a sensor 410 located at the top of the elevator door 404 and is located off center in the door plane. For the side opening elevator door 404, the door movement is from left to right. The sensor 410 location being off center is to obtain the most accurate sensor readings as the elevator door 404 is closing. The field of view 406 of the sensor 410 covers a portion of the code required sensing area 408. However, a non-covered portion 412 exists with this configuration of the sensor 410 for the side opening door 404.

Figure 5:
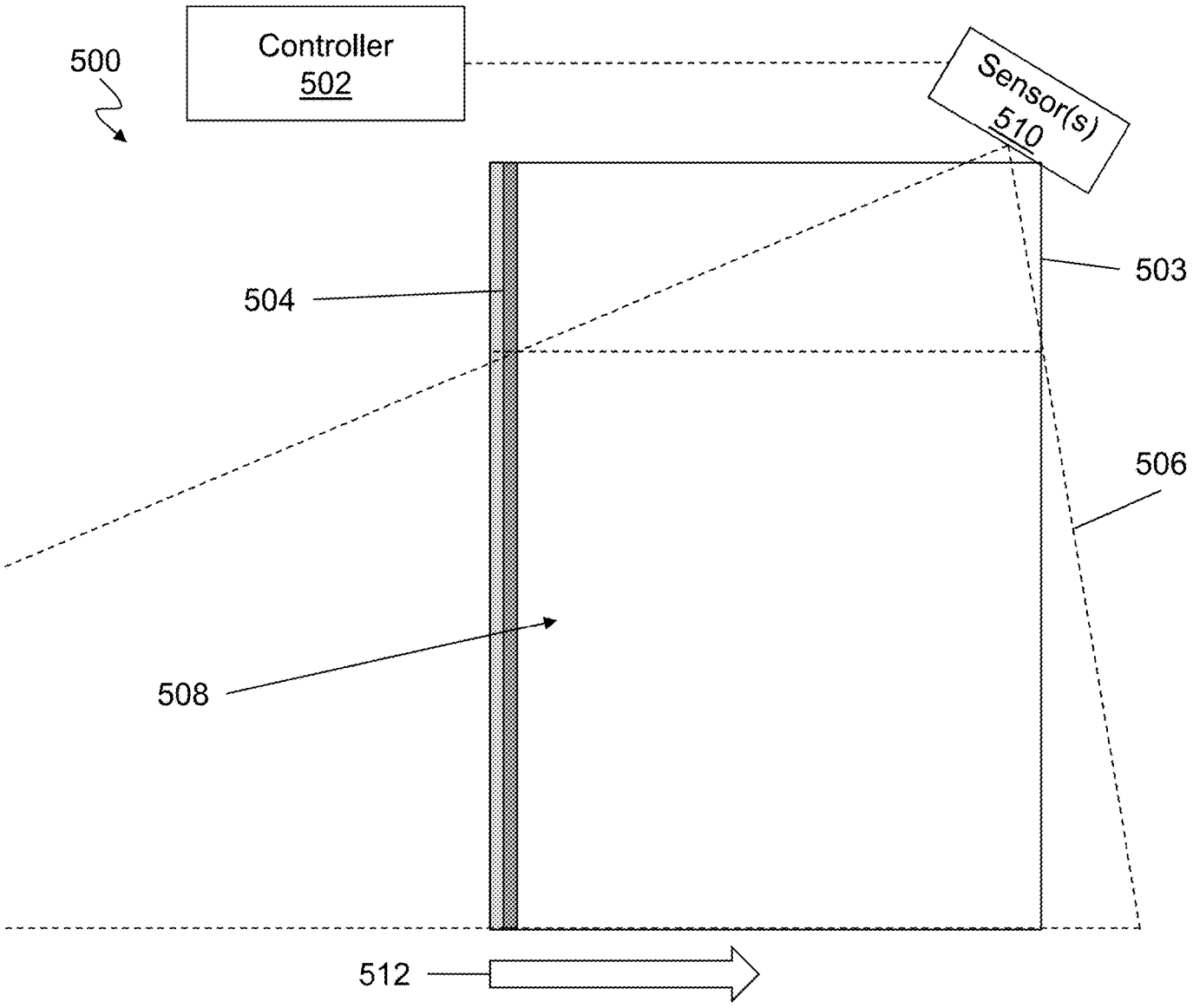
FIG. 5 depicts an door control system with variable sensor orientation for enhanced door detection according to one or more embodiments of the disclosure.

FIG. 5 depicts a door control system for an elevator with variable sensor orientation for enhanced door detection according to one or more embodiments. The door control system 500 includes an elevator controller 502 operable to control the sensor 510 that is mounted on an elevator door frame 503. In the elevator door frame 503 is a side opening elevator door 504 which is in the open state. The closing direction 512 of the side opening elevator door 504 is from left to right. In the illustrated example, the sensor 510 orientation is adapted so that the field of view 506 covers the required sensing area 508. In one or more embodiments, the sensor 510 orientation is variable based on the state of the elevator door 504. In the illustrated example, the elevator door 504 is almost completely open and the sensor 510 orientation is adapted so that the field of view 506 covers almost the entire sensing region 508. In one or more embodiments, a sensor controller and/or a landing door control unit can operate the sensor 510. For example, a landing door control unit can operate the elevator door 504 and initiate an action based upon detecting the presence of a passenger and/or object at or near the elevator door 504 or the elevator door threshold. The action, for example, can be a security measure such as stopping the elevator door 504 from closing and/or reopening the elevator door 504. In one or more embodiments, the elevator controller 502 can perform the action based on detecting the presence of a passenger and/or object.

In one or more embodiments, the controller 502 and sensor 510 can be implemented on the processing system 200 found in FIG. 2. Additionally, a cloud computing system can be in wired or wireless electronic communication with one or all of the elements of the system 500. Cloud computing can supplement, support or replace some or all of the functionality of the elements of the system 500. Additionally, some or all of the functionality of the elements of system 500 can be implemented as a node of a cloud computing system. A cloud computing node is only one example of a suitable cloud computing node and is not intended to suggest any limitation as to the scope of use or functionality of embodiments described herein.

In or more embodiments, the elevator door frame 503 includes the side opening door 504 which extends from left to right when closing and opens from right to left. Typically, sensors are affixed to the top right of the door frame 503 to allow for the center of the field of view 506 to be focused across the opening defined by the elevator door 504. The center of the field of view 506 provides better sensing and detection from the sensor 510. As the elevator door 504 closes and moves from left to right, the sensor 510 can change orientation, by the controller 502, to adjust the field of view 506 as shown in FIG. 6.

In one or more embodiments, the elevator controller 502 can invoke a safety measure when a person or object is detected in the field of view 506. A safety measure can include stopping the door 504 from closing, sound an alarm, cause the door 504 to open, and the like.

Figure 6:
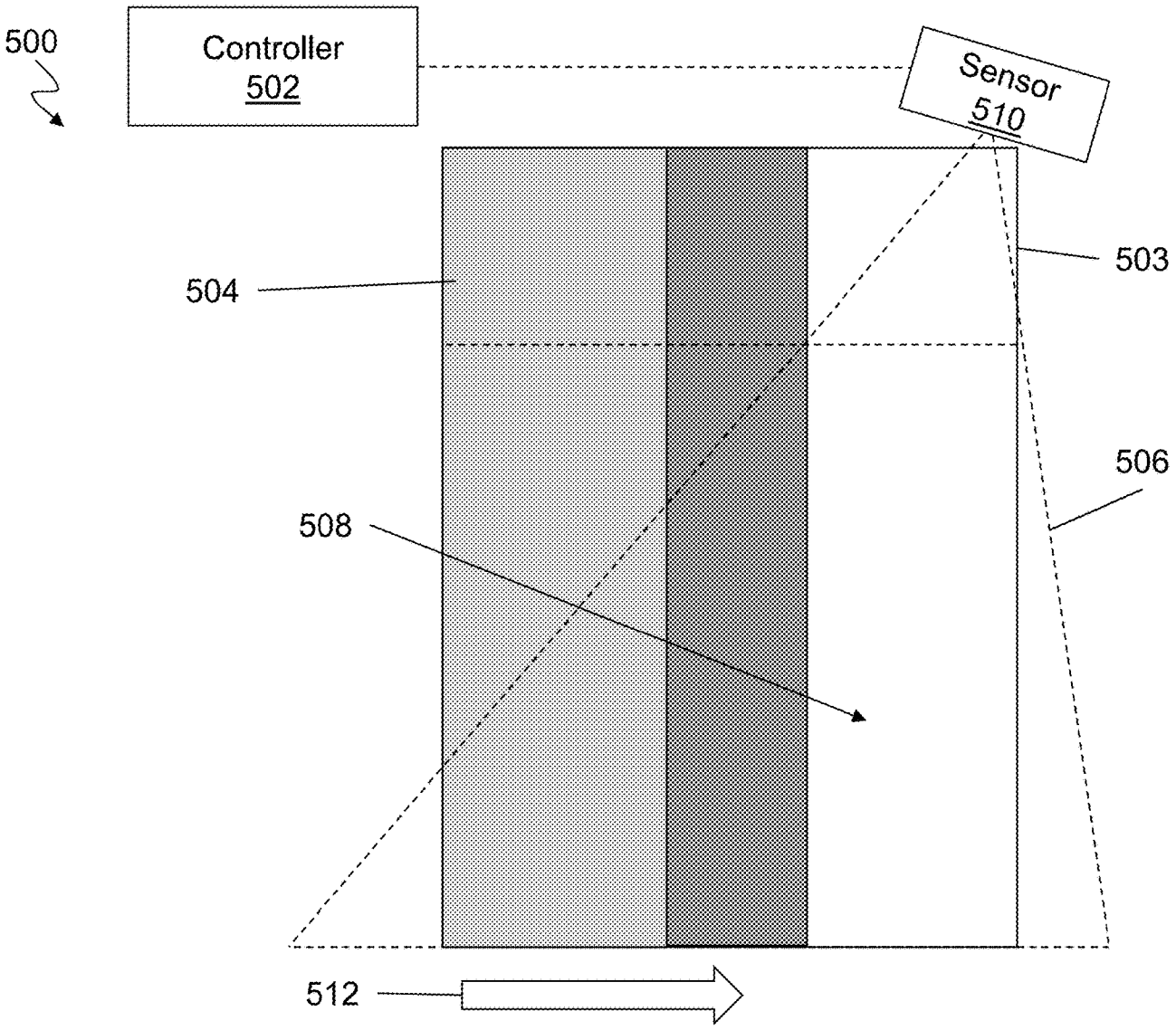
FIG. 6 depicts the door control system with variable sensor orientation as the elevator door is closing according to one or more embodiments of the disclosure.

FIG. 6 depicts the door control system with variable sensor orientation as the elevator door is closing according to one or more embodiments. As depicted in the illustrated example, the door 504 is closing from left to right in the door frame 503. Responsive to the door 504 movement, the controller 502 operates the sensor 510 to change the field of view 506. As the door 504 closes, the sensing area 508 is shrinking and the field of view 506 of the sensor 510 is adjusted by altering the orientation of the sensor 510. As the door 504 is nearing the closed position, the risk of closing on a passenger or object is greater because the door 504 has to travel less distance to potentially cause a pinching point. Because of this increase risk, the field of view of the camera 510 is adjusted so that the center of the field of view is focused on the shrinking door threshold. The center of the field of view for the sensor 510 is typically more reliable and better at detecting the presence of a passenger or object than the peripheral portions of the field of view. Because of the better sensing, the center of the field of view is rotated to stay within the opened portion of the door threshold.

In one or more embodiments, the sensor 510 can be rotated electronically by the controller 502, a door safety control unit, or the sensor 510 itself. The sensor 510 can rotate the field of view across the door threshold. The sensor can also be rotated out from the elevator door 504 to an elevator landing area and be rotated in towards the elevator door 504. In one or more embodiments, the sensor 510 can be rotated mechanically by a mechanical linkage (mechanical coupling) to the elevator door 504. For example, a mechanical connection from the elevator door 504 to the sensor 510 can cause the sensor 510 to rotate as the door 504 opens and closes. An example mechanical connection can include a chain, lever, or the like that orientates the sensor 510 on an axis. The mechanical connection can orientate the sensor 510 axially across the elevator door 504 and axially to and from the elevator door 504 to an elevator landing area. In one or more embodiments, the sensor 510 mechanical linkage can be detached from the door 504 as it opens and closes. For example, during non-peak elevator usage times, the sensor 510 can be fixed where the field of view is across the door opening to save power. The sensing field of view, when the sensor 510 is in the fixed position, would still provide door 504 safety. During peak elevator usage hours, the sensor 510 can re-attached to the elevator door 504 such that the opening and closing of the door 504 causes the sensor 510 to rotate across the door 504 opening and to and from the elevator door 504 in to and away from the elevator landing.

Figure 7:
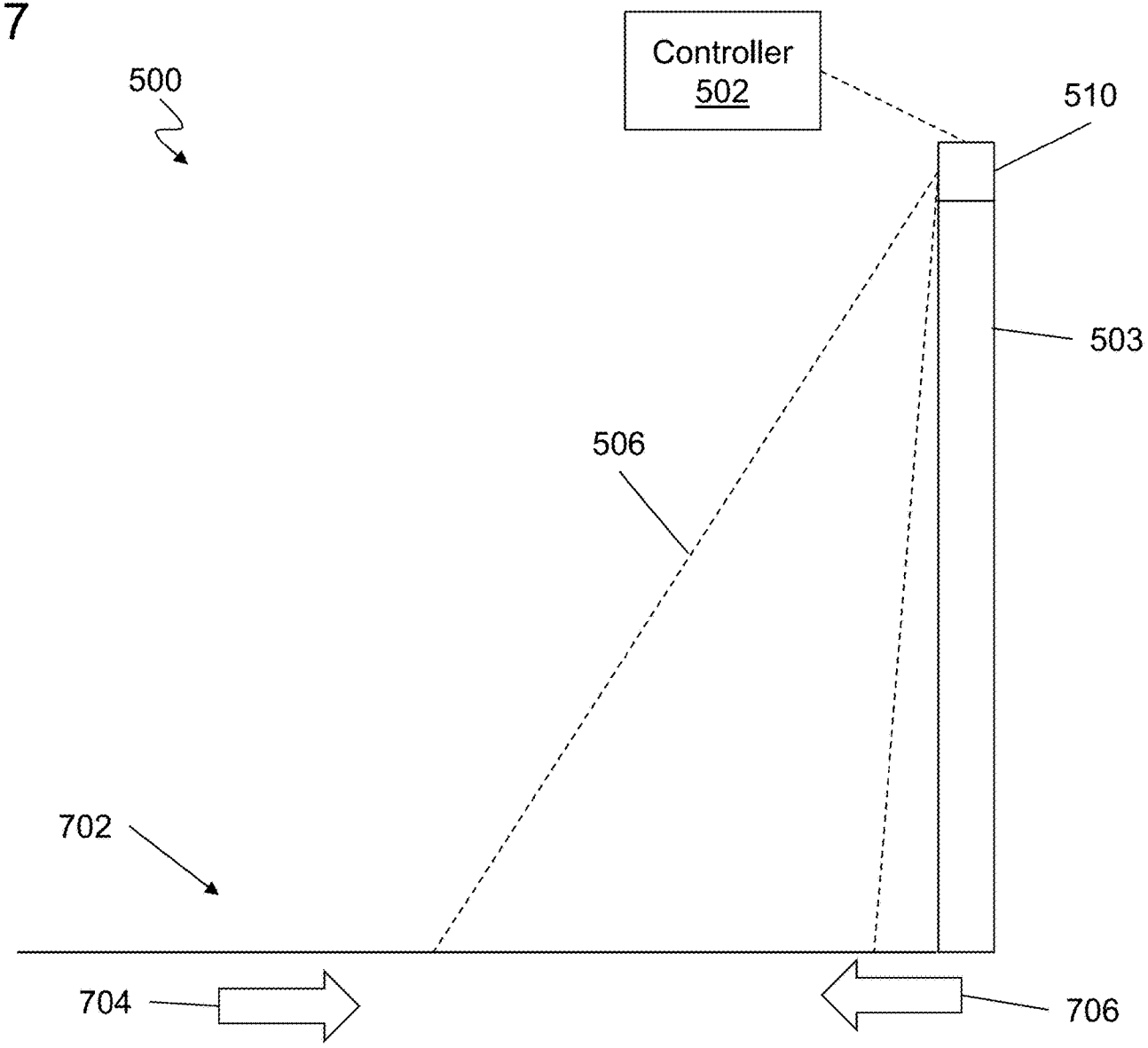
FIG. 7 depicts a side view of the door control system with variable sensor orientation according to one or more embodiments of the disclosure.

FIG. 7 depicts a side view of the door control system with variable sensor orientation according to one or more embodiments. The system 500 includes a controller 502 that operates a sensor 510 affixed to an elevator door frame 503. The controller 502 is operable to orientate the sensor 510 to adjust the field of view 506 of the sensor 510 which covers an elevator landing area 702. The field of view 506 can be adjusted to extend further away from the elevator door when the door is in an open state. As mentioned above, the sensor 510 can be rotated along the door plane as the door closes, and can be articulated toward the door threshold to sense closer to the door plane as the door closes. The field of view 506 can be rotated in an outward direction 706 away from the elevator door frame 503 towards an elevator landing area 702. The field of view 506 can also be rotated in an inward direction 704 towards the elevator door frame 503. As the elevator door is nearing a closed position, the field of view is rotated towards the elevator threshold 503 so that the center of the field of view is closer to the elevator door. As mentioned above, a sensor 510 can typically detect passengers and objects more accurately near the center of the field of view 506 as opposed to peripheral portions of the field of view 506. As the risk of closing on a passenger or object increase, the field of view 506 is adjusted to account for this risk. When the elevator door is in an open state, the field of view 506 can be extended further into the elevator landing area 702 (e.g., elevator lobby). As the door is open, detecting passengers in the elevator landing area can be utilized to keep the door open longer to allow for passengers to enter the elevator car.

In one or more embodiments, the sensor 510 can be operated based on the movement of the elevator door 504. Sensor 510 operations include panning, tilting, and zooming of the sensor field of view. For example, the field of view can be narrowed through zooming the open portion of the door threshold and/or portions of the elevator landing area. With the zooming of the sensor, better detection can be achieved as the door nears the closed position and thus has a greater risk of causing injury due to a passenger getting caught in the threshold as the door closes.

Figure 8:
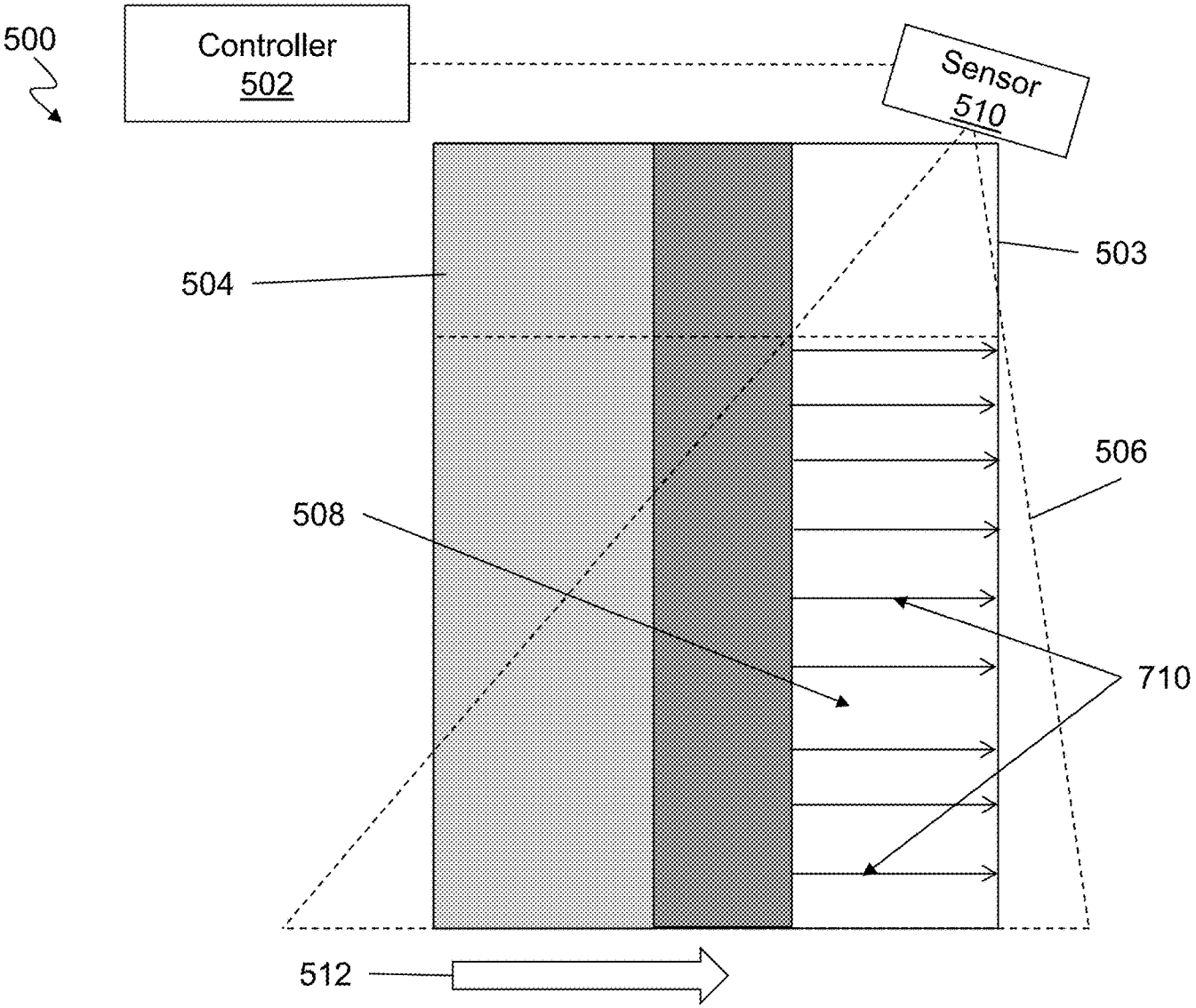
FIG. 8 depicts the door control system with variable sensor orientation and a 3D light curtain sensor according to one or more embodiments of the disclosure.

As depicted in FIGS. 5-7, the alignment and sensor 510 articulation increases passenger safety when interacting with an elevator door 504. FIG. 8 introduces a three dimensional (3D) light curtain as an additional sensor for the elevator system 500.

FIG. 8 depicts the door control system with variable sensor orientation and a 3D light curtain sensor according to one or more embodiments. The 3D light curtain 710 sensors are a combination of 2D beams in the door plane that can sense objects that enter the door threshold in line with the elevator door 504 and 3D beams that are typically oriented at a 45 degree angle relative to the door plane and can sense objects as they approach the elevator door plane. However, drawbacks of both 2D and 3D light curtains 710 include, as the door closes, the sensing area on the landing shrinks until the door closes. These light curtains 710 can miss sensing objects if the objects are located towards the outside of the closing area and the light curtain 710 sensors must be turned off once the beams come within a certain distance of the door 504 closing. The sensor 510 affixed to the elevator door frame 503 can cover the sensing areas that are missed by the 3D light curtains 710.

Figure 9:
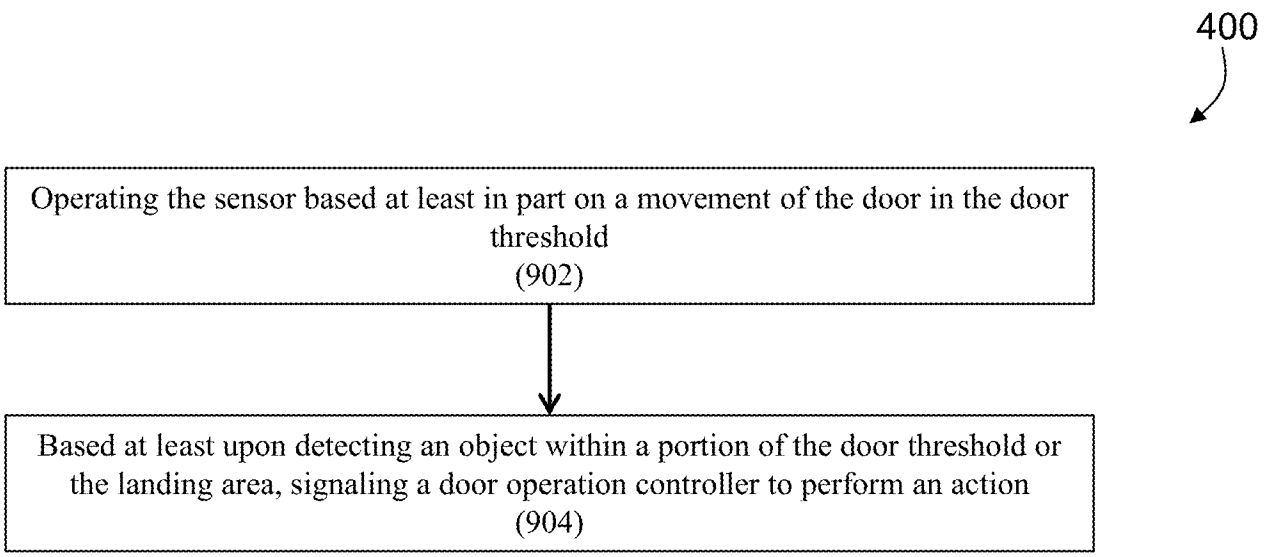
FIG. 9 depicts a flow diagram of a method for operating a door control system according to one or more embodiments of the disclosure.

FIG. 9 depicts a flow diagram of a method for operating a door control system according to one or more embodiments. The door control system includes a sensor having a field of view in proximity to a door threshold of an entrance to an occupancy area, wherein the sensor is adapted to detect objects in the door threshold and a landing area proximate to the door. The method 900 includes operating the sensor based at least in part on a movement of the door in the door threshold, as shown in block 902. And at block 904, the method 900 includes based at least upon detecting an object within a portion of the door threshold or the landing area, signaling a door operation controller to perform an action.

In one or more embodiments, the door operation controller can perform an action including stopping an elevator door from closing and/or reopening the elevator door. Other actions include providing an alert such as an audio alarm or a visual alert such as a flashing light.

Additional processes may also be included. It should be understood that the processes depicted in FIG. 9 represent illustrations and that other processes may be added or existing processes may be removed, modified, or rearranged without departing from the scope and spirit of the present disclosure.

In one or more embodiments, the "field of view" of the sensor can be adjusted by various means: mechanical, by rotating the entire sensor around one or both of its axes; electronic, in case of radar-type sensor, where the beam can be electronically steered, or the beam can be dynamically deflected by some e.g. metamaterial placed in front of the radar antenna, and the metamaterials characteristics modulated by some external means (changing capacitance by varactor diodes or changing coupling using appropriate liquid crystal shields); or just mechanically steering optic elements if infrared light is used (which also applies to time of flight (ToF) sensors), and not the entire sensor housing.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A door control system comprising:

a sensor having a field of view in proximity to a door threshold of an entrance to an occupancy area, wherein the sensor is adapted to detect objects in the door threshold and a landing area proximate to the door threshold;

wherein the sensor is operated based on a movement of a door in the door threshold, wherein operating the sensor comprises adjusting the field of view of the sensor as a door closes across the door threshold; and based at least upon detecting an object within a portion of the door threshold or the landing area, the sensor operable to signal a door operation controller to perform an action.

2. The door control system of claim 1, wherein the sensor is mechanically coupled to the door.

3. The door control system of claim 2, wherein the field of view of the sensor is adjusted by movement of the door based on the mechanical coupling.

4. The door control system of claim 1, wherein operating the sensor comprises adjusting the field of view of the sensor in the door threshold.

5. The door control system of claim 1, wherein operating the sensor comprises adjusting the field of view of the sensor in the landing area proximate to the door threshold.

6. The door control system of claim 1, wherein operating the sensor based at least in part on the movement of the door comprises:

responsively adjusting the sensor to align a center of the field of view within an opening defined by the door in the door threshold.

7. The door control system of claim 6, wherein adjusting the sensor comprises at least one of:

panning the sensor, tilting the sensor, and adjusting a zoom of the sensor.

8. The door control system of claim 1, wherein the door control system further comprises:

a light curtain in proximity to the door, wherein the light curtain is adapted to detect objects in the door threshold when the door is in an open state.

9. The door control system of claim 1, wherein the sensor comprises at least one of:

a radar sensor, a time of flight sensor, an infrared sensor, a three dimensional light curtain, and an optical sensor.

10. The door control system of claim 1, wherein the action comprises engaging a security measure for the door.

11. The door control system of claim 1, wherein adjusting the field of view of the sensor as the door closes across the door threshold comprises changing orientation of the sensor as the door closes, wherein a center of the field of view is rotated to stay within an opened portion of the door threshold.

12. The door control system of claim 1, wherein adjusting the field of view of the sensor comprises adjusting the field of view of the sensor electronically or mechanically.

13. A method for operating a door control system, the door control system comprising a sensor having a field of view in proximity to a door threshold of an entrance to an occupancy area, wherein the sensor is adapted to detect objects in the door threshold and a landing area proximate to the door, the method comprising:

operating the sensor based at least in part on a movement of the door in the door threshold, wherein operating the sensor comprises adjusting the field of view of the sensor as a door closes across the door threshold; and based at least upon detecting an object within a portion of the door threshold or the landing area, signaling a door operation controller to perform an action.

14. The method of claim 13, wherein the sensor is mechanically coupled to the door.

15. The method of claim 14, wherein the field of view of the sensor is adjusted by movement of the door based on the mechanical coupling.

16. The method of claim 13, wherein operating the sensor comprises adjusting the field of view of the sensor in the door threshold.

17. The method of claim 13, wherein operating the sensor comprises adjusting the field of view of the sensor in the landing area proximate to the door threshold.

18. The method of claim 13, wherein operating the sensor based at least in part on the movement of the door comprises:

responsively adjusting the sensor to align a center of the field of view with an opening defined by the door in the door threshold.

19. The method of claim 18, wherein adjusting the sensor comprises at least one of:

panning the sensor, tilting the sensor, and adjusting a zoom of the sensor.

20. The method of claim 13, wherein the door control system further comprises:

a light curtain affixed to the door, wherein the light curtain is adapted to detect objects in the door threshold when the door is in an open state.

21. The method of claim 13, wherein adjusting the field of view of the sensor as the door closes across the door threshold comprises changing orientation of the sensor as the door closes, wherein a center of the field of view is rotated to stay within an opened portion of the door threshold.

22. The method of claim 13, wherein adjusting the field of view of the sensor comprises adjusting the field of view of the sensor electronically or mechanically.

* * * * *